US005913500A

United States Patent [19]

Estes

[11] Patent Number: 5,913,500

[45] Date of Patent: Jun. 22, 1999

[54] TOOL HANGING DEVICE

[76] Inventor: Georgia Estes, 1008 SW. 114 Ter., Fort Lauderdale, Fla. 33325

[21] Appl. No.: 08/910,934

[22] Filed: Aug. 9, 1997

[51] Int. Cl.[6] ..... A44B 1/18

[52] U.S. Cl. ..... 248/205.2; 248/110

[58] Field of Search ..... 248/205.2, 52, 248/110; 24/31 V, 306; 52/DIG. 13; 128/DIG. 15; 428/100

[56] References Cited

U.S. PATENT DOCUMENTS

| | | | |
|---|---|---|---|
| 4,878,274 | 11/1989 | Patricy | 24/306 |
| 4,971,593 | 11/1990 | Mayhall et al. | 248/205.2 |
| 5,044,038 | 9/1991 | Matkovic | 248/110 |
| 5,075,933 | 12/1991 | Kemper | 24/306 |
| 5,551,657 | 9/1996 | Liethen | 24/306 |
| 5,595,014 | 1/1997 | Moore | 24/306 |
| 5,607,452 | 3/1997 | Michaud | 24/306 |
| 5,626,318 | 5/1997 | Boettger et al. | 248/205.2 |
| 5,671,849 | 9/1997 | Bacon | 248/205.2 |
| 5,676,137 | 10/1997 | Byrd | 128/DIG. 15 |

*Primary Examiner*—Ramon O. Ramirez
*Assistant Examiner*—Robert Lipcsik
*Attorney, Agent, or Firm*—Malin, Haley, DiMaggio & Crosby

[57] ABSTRACT

A tool hanging device is disclosed for hanging tools, and in particular various sizes of handled tools such as rakes, shovels, brooms, hoes, etc. in sheds, garages, and other areas. The tool hanging device is preferably two separate pieces and generally consists of a hook first portion associated with a wall area and a loop second portion preferably attached to the handle of the tool. The hook first portion and loop second portion are designed to work in combination with each other to hang handled tools to the wall or beam area of a structure, such as, a metal shed.

19 Claims, 2 Drawing Sheets

TOOL HANGING DEVICE

BACKGROUND OF THE INVENTION

1. Field of the Invention

The present invention relates generally to tool hanging devices, and more particularly to a device for hanging tools within a shed or wall area.

2. Description of the Background Art

Many homeowners utilize sheds for storing various items, including fishing rods, lawn mowers, and various types of tools, including long-handled tools. Often, the tools are merely thrown or placed in the shed in a disorganized manner. Furthermore, with sheds constructed from metal, it is impractical to drill holes in the shed for hanging brackets or other types of hanging devices.

Currently, there exists a need for a hanging mechanism for long-handled tools to be used when a power drill is not available and/or the use of a power drill would be inappropriate.

Thus, it is to the aforementioned problems that the present invention is directed.

SUMMARY OF THE INVENTION

The present invention provides a device for hanging tools, and in particular various sizes of handled tools such as rakes, shovels, brooms, hoes, etc. in sheds, garages, and other areas. The tool hanging device is preferably two separate pieces and generally consists of a hook first portion associated with a wall area and a loop second portion preferably attached to the handle of the tool.

The hook first portion and loop second portion are designed to work in combination with each other to hang handled tools to the wall or beam area of a structure, such as, a metal shed. Preferably, at least the hook and loop member of the respective portions are constructed from plastic. The hook first portion can be attached to a flat, vertical surface by conventional means such as mounting tape, adhesive, welding etc. The loop second portion is wrapped around the handle of the tool, and then hung on the hook component of the first portion. Similar adhesive, hook and loop fastening means, mounting tape or other conventional means can be utilized to attach the loop second portion to the handle of the tool.

The present invention is easy to use, convenient, relatively strong, and provides for economy of space, neatness, easy accessibility, as well as no damage to the walls from drilling. The hook and loop components can be produced from plastic as well as other conventional materials. In one embodiment, the loop component and the rest of second portion can be constructed integral. The hook component and the rest of first portion can also be constructed integral. However, such is not limiting and other construction embodiments can be utilized such as adhesives, sewing, molding, welding, hook and loop fastening devices, tapes, etc.

Accordingly, it is an object of the present invention to provide a tool hanging device which can neatly and safely hang and organize tools stored within a structure, such as a shed.

It is another object of the present invention to provide a tool hanging device which permits one of a plurality of tools to be hung at a specific location within a structure.

It is still another object of the present invention to provide a tool hanging device which permits a tool to be hung in an area, where normally it is not feasible for hanging tools, such as metal sheds.

It is yet another object of the present invention to provide a tool hanging device which is easy to use and relatively inexpensive to manufacture.

In accordance with these and other objects which will become apparent hereinafter, the instant invention will now be described with particular reference to the accompanying drawings.

BRIEF DESCRIPTION OF THE DRAWINGS

The invention may be better understood by reference to the drawings in which.

DESCRIPTION OF THE PREFERRED EMBODIMENTS

Figure 3:
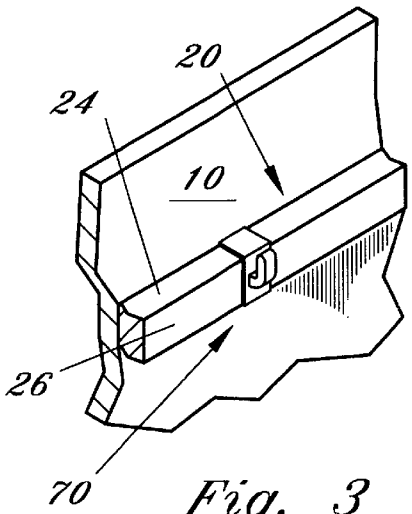
FIG. 3 is a perspective view of a hook portion of the tool hanging device attached to a wall area.
Figure 2:
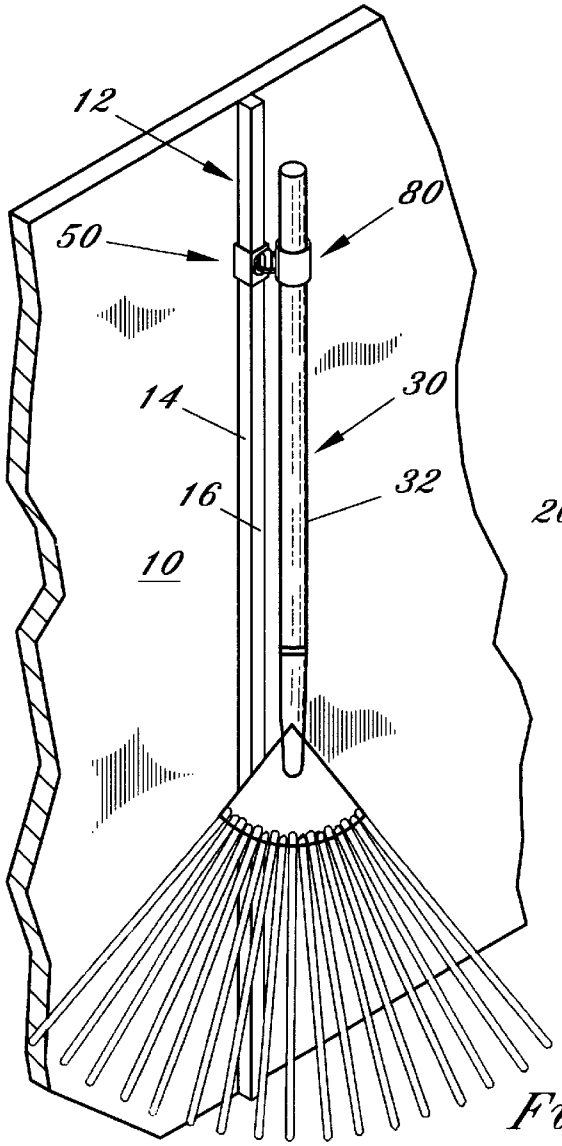
FIG. 2 is a perspective view of the present invention tool hanging device showing the tool hung from the wall area.
Figure 1:
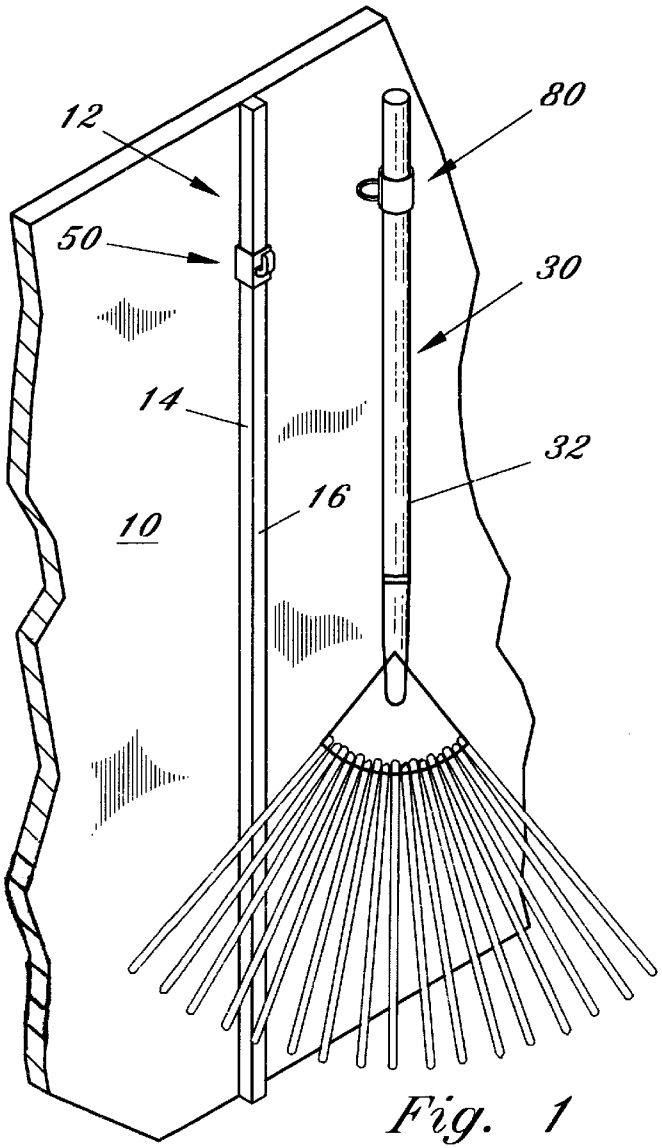
FIG. 1 is a perspective view of the present invention tool hanging device prior to hanging a tool to a wall area.

As best seen in FIGS. 1 and 2 a device for hanging a tool 30 to a wall area 10 is shown. In one embodiment, the wall area is an inner surface of a metal shed, which includes vertical beams 12 and horizontal cross beams 20. Though the present invention is ideally utilized with metal sheds, such is not limiting, and it should be understood that the tool hanging device can be utilized with other walled structures. Vertical beam 12 is preferably provided with an outer surface 16 and side surfaces 14, whereas cross beam 20 is provided with an outer surface 26 and top and bottom surfaces 24.

Figure 4:
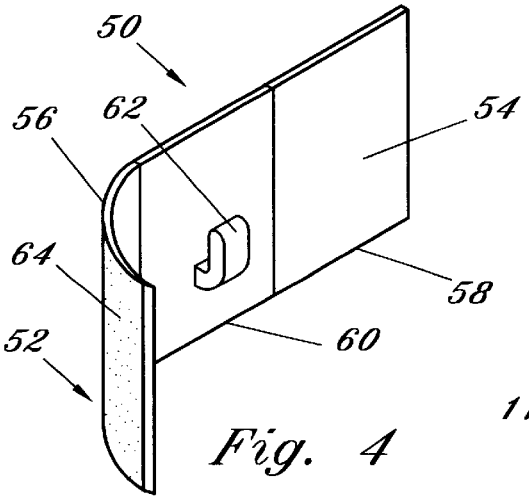
FIG. 4 is a perspective view of a first embodiment for the hook portion of the tool hanging device in accordance with the present invention.

In one embodiment, the tool having device generally consists of a hook portion 50 and a loop portion 80. FIG. 4 illustrates a first embodiment for the hook portion and is generally designated hook portion 50. Hook portion 50 includes a hook member 62 attached to a body member 52 which is preferably attached to vertical beam 12. However, it should be understood that hook portion 50 can also be attached to a flat wall area or other flat area, and such attachment is also within the scope of the invention. Preferably an adhesive member 64 is provided along a majority of an inner surface of body member 52 to attach hook portion 50 to vertical beam 12. A paper cover (not shown), or other similar material, can be disposed over adhesive member 64 until hook portion 50 is ready to be attached to vertical beam 12. When attachment is desired, the paper cover is simply removed to expose the adhesive.

Hook portion 62 is preferably constructed from a relatively hard plastic, though other materials which will provide for a relatively rigid hook can be utilized and are considered within the scope of the invention. When properly attaching hook portion 62 to vertical beam 12, a first portion 56 of body member 52 is adjacent first side portion 14, a second portion 54 of body member 52 is adjacent a second side portion 14, and a middle portion 60 of body member 52 is adjacent front side portion 16 of vertical beam 12.

Though not limiting, middle portion 60 can be constructed relatively rigid, as compared to first portion 56 and second portion 54. In this embodiment, first portion 56 and second portion 54 are relatively flexible to permit portions 54 and 56 to be wrapped or bent around the respective side portions 14 of vertical beam 12. Also in this embodiment, inner ends of first portion 56 and 54 can be attached to middle portion by any conventional means, such as welding, gluing, adhesives, epoxies, sewing, etc. Where hook portion 50 is attached to a flat wall area or other wall area, such as wall 10, the body member can be entirely constructed of a relatively rigid material and can be shorter in length than body member 52, as it is not required to wrapped around a beam or pole.

Furthermore, where attaching hook portion 50 to vertical beam 12, body member 52 can also be constructed integral of a relatively flexible material. In this embodiment, hook member 62 is attached to middle portion 60 by any conventional means which will securely retain hook member 62 to middle portion 60 in a operable position, such as sewing, welding, etc. Where middle portion 60 is constructed from a rigid material, hook member 62 can be constructed integral with middle portion 60.

Alternatively, body member 52 can consist of a flexible strip, having adhesive 64 disposed on at least a portion of an inner surface, and a rigid member (not shown), but similar to middle portion 60, attached to the outer surface of the flexible strip, by conventional means such as adhesive. In this alternative construction embodiment, hook member 62 is constructed integral with the rigid member or attached to the rigid member similar to how hook member 62 is attached to middle portion 60, described above.

Figure 5:
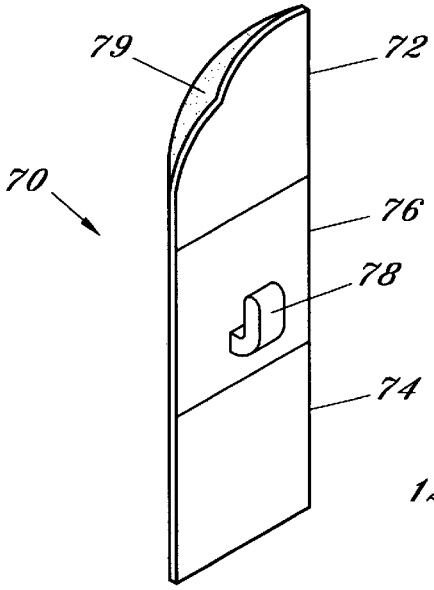
FIG. 5 is a perspective view of a second embodiment for the hook portion of the tool hanging device in accordance with the present invention.

As seen in FIG. 5, a second embodiment hook portion 70 is illustrated for attachment to a horizontal extending beam 20. Hook portion 70 can be constructed similar to any of the above described construction embodiments and with similar materials as described for hook portion 50. Hook portion 70 basically differs from hook portion 50 in the orientation of hook member 78 as compared to hook member 62. Hook member 78 is orientated approximately ninety (90°) degrees different from hook member 62 to compensate for its preferred attachment to horizontal beam 20. However, it should be understood that hook portion 70 can also be attached to a wall area or other flat area, and such attachment is also considered within the scope of the invention.

Preferably, tools with smaller length handles would be hung from horizontal beam 20, while the longer handled tools, such as tool 30, would preferably be hung from vertical beam 12, in view of the normal vertical position of horizontal beam 20 in relation to the floor or ground. Preferably, with either hook portion 50 or 70, the exposed end of the associated hook member is pointing upwards, when the hook portion is properly attached to vertical beam 12, horizontal beam 20, wall area 10 or other flat area.

Figure 7:
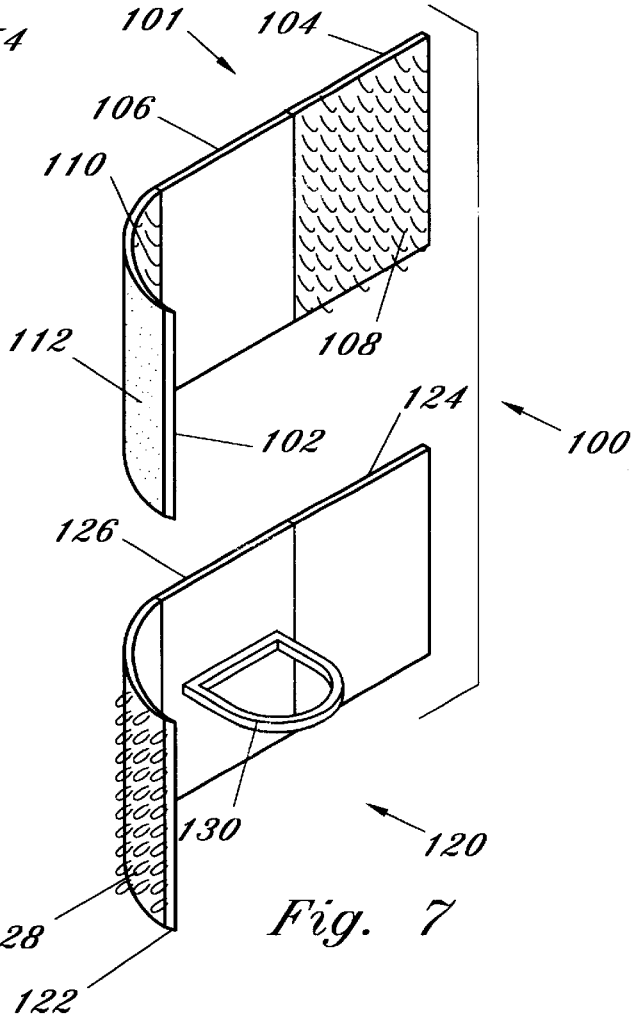
FIG. 7 is a perspective view of a second embodiment for the loop portion of the tool hanging device in accordance with the present invention.
Figure 6:
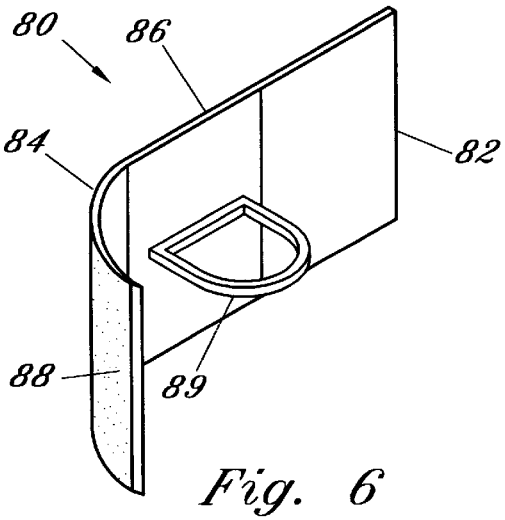
FIG. 6 is a perspective view of a first embodiment for the loop portion of the tool hanging device in accordance with the present invention.
Figure 8:
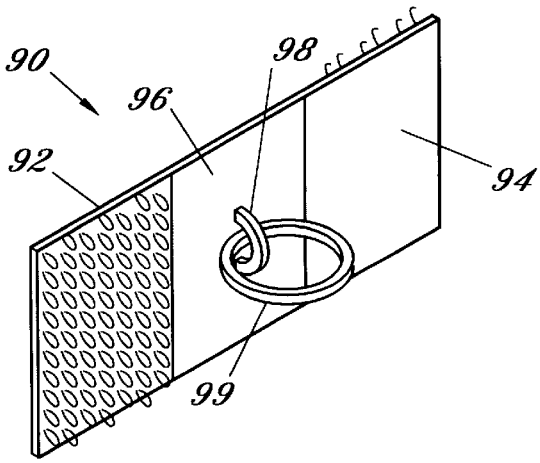
FIG. 8 is a perspective view of a third embodiment for the loop portion of the tool hanging device in accordance with the present invention.

FIGS. 6, 7 and 8 illustrate various embodiments for the loop portion of the present invention tool hanging device. As seen in FIG. 6, loop portion 80 consist of rigid middle portion 86 having a loop member 89 constructed integral therewith or attached to middle portion 86 by conventional means such as welding, adhesives, etc. Loop member 89, as well as the other loop members discussed below, should also be relatively rigid.

Attached to middle portion 86 are flexible side portions 82 and 84. Side portions 82 and 84 can be attached by conventional means such as welding, adhesives, etc. Alternatively, a single flexible strip can be provided to which a rigid middle portion is attached at the approximate center by conventional means such as adhesive. In either construction, the flexible portions of loop portion 80 are wrapped around a portion of a handle 32 of tool 30, and preferably near the exposed end of handle 32. An adhesive 88 is provided on an inner surface of loop portion 80 to retain loop portion 80 around handle 32. Though not preferred, other attachment methods, such as tapes, nails, etc. could be utilized and are considered within the scope of the invention.

FIG. 7 illustrates a second embodiment for the loop portion is generally designated as loop portion 100 having a loop member 130. In this embodiment, loop portion 100 consists of two members. A first member 101 is flexible and provided with adhesive 112 along an inner portion for attachment to handle 32 of tool 30, similar to other embodiments described above. At least side portions 102 and 104 are provided with hook and loop fastening means 110 and 108, respectively, for mating with hook and loop fastening means 128 disposed along an inner surface of the second member of loop portion 100. Though not shown, hook and loop fastening means can be disposed along the entire outer surface of first member 101 for mating with hook and loop fastening means disposed along the entire inner surface of the second member of loop portion 100.

Besides providing hook and loop fastening 128 in where adhesive 88 was disposed (FIG. 6), the second member of loop portion is constructed similar to loop portion 80, described above. In one embodiment, middle portions 126 and 86 and loop member 89 and 130 can be constructed integral and from a rigid plastic material, though such is not limiting and other materials and construction methods can be utilized and are considered within the scope of the invention. This embodiment, allows the user to remove the loop member while utilizing the tool, and quickly and easily reattached the loop member to the first member still attached to the handle after the user is finished with the tool.

FIG. 8 illustrates another alternative embodiment for the loop portion and is generally designated as loop portion 90. In this embodiment, loop portion 90 is attached to handle 32 by wrapping flexible loop portion 90 around handle 32 such that portion 94 is disposed over portion 92 to allow their respective hook and loop fastening means to mate and retain loop portion 90 on handle 32. Adhesive means (not shown) can also be provided on the inner surface of portion 92 and 96 to help retain the attachment of loop portion 90 properly to handle 32.

A loop member 99 is retained by a small ring member 98 attached to middle portion 96 by conventional means such as sewing, etc. Loop member 99 and ring member 98 can be constructed from metal, though such is not limiting and other materials can be utilized and are considered within the scope of the invention. Furthermore, middle portion 96 can be constructed from a rigid material and/or be provided with a loop member similar to loop member 89.

It should be understood that the various construction methods and materials utilized for the various embodiments of loop portions can be interchangeable and are not considered limited to the specific embodiments illustrated in the figures.

Furthermore, a paper cover (not shown), or other similar material, can also be disposed over the adhesive members associated with the loop portions until the loop portion is ready to be attached to handle 32. When attachment is desired, the paper cover is simply removed to expose the adhesive.

In all embodiments, once the loop portion is properly attached to handle 32, tool 30 is hung to wall area 10, by passing the loop member over the hook member of hook portion 50 or 70. Hook portion 50 or 70 is constructed strong enough to support the weight of tool 30 and properly retains tool 30 in a neat, safe, and organize location within the area, such as a tool shed.

Furthermore, it should be understood that the length and shape of the body members of the hook portions and the loop portions are selected to correspond to the shape and dimensions, of the wall area, beams and handles to which they are to be attached and are not considered limited to any one shape or dimension.

Though not limiting, in one embodiment the body member of the hook portion can approximately measure six (6) inches in length and two (2) inches in width, while the body member for the loop portion can approximately measure four (4) inches in length and two (2) inches in width.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A device for hanging a tool from a wall area, comprising:

a first body member, said first body member adapted to be attached to a surface;

a first means for attaching said first body member to the surface;

a second body member, said second body member adapted to be attached to a tool to be hung from the wall area, the tool having an elongated handle wherein said second body member is adapted to be attached to the elongated handle; and a second means for attaching said second body member to said tool wherein the tool can hang substantially vertically adjacent the wall area, after attachment said second body member remains attached to the elongated handle while the tool is in use.

2. The device for hanging a tool of claim 1 wherein said first body member includes a hook component and said second body member includes a loop component.

3. The device for hanging a tool of claim 1 wherein said first means for attaching is an adhesive.

4. The device for hanging a tool of claim 1 wherein said second means for attaching is an adhesive.

5. A device for hanging a tool from a wall area, comprising:

a first hanging member adapted to be attached to a surface of said wall area, said first hanging member having a hook member protruding outward therefrom;

means for attaching said first hanging member to the surface of said wall area;

a second hanging member adapted to be attached to an elongated semi-rigid handle member of the tool, said second hanging member having a loop member protruding outward therefrom; and means for attaching said second hanging member to the elongated handle member of said tool, after attachment said second hanging member remains attached to the elongated handle member while the tool is in use;

wherein when hanging said tool from the wall area said first hanging member is attached to said wall area and said second hanging member is attached to said tool and said loop member is disposed around said hook member, the tool hanging substantially vertically.

6. The tool hanging device of claim 5 wherein said means for attaching said first hanging member is an adhesive member disposed on at least a portion of an inner surface of said first hanging member.

7. The tool hanging device of claim 5 wherein said means for attaching said second hanging member is an adhesive disposed on at least a portion of an inner surface of said second hanging member.

8. The tool hanging device of claim 5 wherein said first hanging member is attached to a wall area of a conventional metal shed.

9. The tool hanging device of claim 5 wherein said first hanging member is attached to a vertical member such that an exposed end of said hook member is pointing upward.

10. The tool hanging device of claim 5 wherein said first hanging member is attached to a horizontal member such that an exposed end of said hook member is pointing upward.

11. The tool hanging device of claim 5 wherein said second hanging member comprises:

a first portion attached to a handle member of the tool;

a second portion including the loop member; and means for attaching the second portion to the first portion.

12. The tool hanging device of claim 11 wherein said means for attaching includes a first hook and loop fastening means disposed along at least a segment of an outer surface of said first portion and a second hook and loop fastening means disposed along at least a segment of an inner surface of said second portion; wherein said first hook and loop fastening means mates with said second hook and loop fastening means when attaching said first portion to said second portion.

13. A device for hanging a tool from an area of a structure, comprising:

a first hanging member adapted to be attached to a surface of said wall area, said first hanging member having a relatively rigid hook member protruding outward therefrom, said first hanging member having an adhesive disposed along at least a portion of its inner surface for attaching said first hanging member to the surface;

a continuous unitary second hanging member adapted to be at least semipermanently attached to a relatively rigid handle member of the tool, said second hanging member having a relatively rigid loop member protruding outward therefrom; and means for attaching said second hanging member to the handle member of said tool, after attachment said second hanging member remains attached to the handle member while the tool is in use;

wherein when hanging said tool from the wall area said first hanging member is attached to said wall area and said second hanging member is attached to said tool and said loop member is disposed around said hook member.

14. The tool hanging device of claim 13 wherein said means for attaching said second hanging member is an adhesive disposed on at least a portion of an inner surface of said second hanging member.

15. The tool hanging device of claim 13 wherein said first hanging member is attached to a wall area of a conventional metal shed.

16. The tool hanging device of claim 13 wherein said first hanging member is attached to a vertical member such that an exposed end of said hook member is pointing upward.

17. The tool hanging device of claim 5 wherein said first hanging member is attached to a horizontal member such that an exposed end of said hook member is pointing upward.

18. The tool hanging device of claim 13 wherein said second hanging member comprises:

a first portion attached to a handle member of the tool;

a second portion including the loop member; and means for attaching the second portion to the first portion, said means for attaching includes a first hook and loop fastening means disposed along at least a segment of an outer surface of said first portion and a second hook and loop fastening means disposed along at least a segment of an inner surface of said second portion; wherein said first hook and loop fastening means mates with said second hook and loop fastening means when attaching said first portion to said second portion.

19. The tool hanging device of claim 13 wherein said second hanging member is adapted to be attached to said tool near the outer end of said handle member.

* * * * *